US010597907B2

(12) United States Patent
Yamashita et al.

(10) Patent No.: US 10,597,907 B2
(45) Date of Patent: Mar. 24, 2020

(54) VEHICLE DOOR OPERATING DEVICE

(71) Applicant: Mitsui Kinzoku Act Corporation, Yokohama-shi (JP)

(72) Inventors: Kohei Yamashita, Yokohama (JP); Shigenori Hiramoto, Yokohama (JP)

(73) Assignee: Mitsui Kinzoku Act Corporation (JP)

( * ) Notice: Subject to any disclaimer, the term of this patent is extended or adjusted under 35 U.S.C. 154(b) by 794 days.

(21) Appl. No.: 15/129,704

(22) PCT Filed: Nov. 5, 2014

(86) PCT No.: PCT/JP2014/079313
§ 371 (c)(1),
(2) Date: Sep. 27, 2016

(87) PCT Pub. No.: WO2015/151326
PCT Pub. Date: Oct. 8, 2015

(65) Prior Publication Data

US 2017/0183893 A1 Jun. 29, 2017

(30) Foreign Application Priority Data

Apr. 3, 2014 (JP) ..... 2014-076797

(51) Int. Cl.
*E05B 81/64* (2014.01)
*E05B 77/26* (2014.01)
*E05B 77/24* (2014.01)

(52) U.S. Cl.
CPC ..... *E05B 77/26* (2013.01); *E05B 77/245* (2013.01); *E05B 81/64* (2013.01)

(58) Field of Classification Search
CPC ..... E05B 77/26; E05B 77/245; E05B 81/64
See application file for complete search history.

(56) References Cited

U.S. PATENT DOCUMENTS 4,487,441 A * 12/1984 Miyamoto ..... E05B 77/265 292/216
5,893,593 A * 4/1999 Dowling ..... E05B 77/26 292/169.11

(Continued)

FOREIGN PATENT DOCUMENTS

JP 2012-184578 A 9/2012
JP 2012-241346 A 12/2012
JP 2013-147824 A 8/2013

*Primary Examiner* — Carlos Lugo
(74) *Attorney, Agent, or Firm* — Skinner and Associates; Joel Skinner

(57) ABSTRACT

A vehicle door operating device includes an opening inside lever connected to an inside handle in a door inside a vehicle, a childproof lock lever that moves between a childproof unlock position and a childproof lock position; a switch lever, a childproof sensor and a single engagement pin. When the childproof lock lever is in the childproof lock position, opening action of the inside handle cannot be transmitted to a door latch device, but can be transmitted to the switch lever. When the childproof lock lever is in the childproof unlock position, releasing action of the opening inside lever can be transmitted to door latch devices for holding a door closed via a single engagement pin, but cannot be transmitted to the switch lever. When the childproof lock lever is in the childproof lock position, the releasing action of the opening inside lever cannot be transmitted to the door latch device via the engagement pin, but can be transmitted to the switch lever.

1 Claim, 13 Drawing Sheets

(56) References Cited

U.S. PATENT DOCUMENTS

| | | | | |
|---|---|---|---|---|
| 6,135,513 | A * | 10/2000 | Hamada | E05B 77/26 292/201 |
| 6,332,634 | B1 * | 12/2001 | Fukumoto | E05B 81/20 292/201 |
| 7,438,331 | B2 * | 10/2008 | Wakatsuki | E05B 81/20 292/201 |
| 7,591,493 | B2 * | 9/2009 | Nozawa | E05B 77/265 292/216 |
| 9,284,758 | B2 * | 3/2016 | Yokomori | E05B 85/10 |

* cited by examiner

VEHICLE DOOR OPERATING DEVICE

BACKGROUND OF THE INVENTION

The present invention relates to a vehicle door operating device comprising a childproof mechanism that turns on/off to enable operation of an inside handle to be transmitted or not to be transmitted to a door latch device.

With such a vehicle door operating device in a sliding door that opens and closes with a motor, when the childproof mechanism is in an unlock state, opening action of an inside handle can be transmitted to a door latch device for holding the sliding door in a fully-closed position, but cannot be transmitted to a switch lever. When the childproof mechanism is in a lock state, opening action of the inside handle cannot be transmitted to the door latch device but can be transmitted to the switch lever thereby turning the childproof sensor on to detect the opening action of the inside handle as disclosed in JP2012-184578A.

The door opening device in JP2012-184578A comprises an inside handle lever 110 that moves with the inside handle IH; a first link lever 120 that is pivotally mounted via the same shaft as that of the inside handle lever 110; a childproof lock lever 140 that pivots between an unlock position and a lock position; a first engagement pin 124 via which releasing action of the inside handle lever 110 with the opening action of the inside handle IH can be transmitted to the first link lever 110 when the childproof lock lever 140 is in the unlock position and releasing action of the inside handle lever 110 cannot be transmitted to the first link lever 110; a switch lever 150 that is pivotally mounted via a shaft that is not for inside handle lever 110; a second engagement pin 155 via which releasing action of the inside handle lever 110 cannot be transmitted to the switch lever 150 when the childproof lock lever 140 is in an unlock position and the releasing action of the inside handle lever 110 can be transmitted to the switch lever 150 when the childproof lock lever 140 is in a lock position; and a childproof sensor (second inside handle action sensor S2 in JP2012-184578A) that detects action of the switch lever 150. A childproof mechanism in JP2012-184578A comprises the childproof lock lever 140, first engagement pin 124 and second engagement pin 155.

However, the invention in JP2012-184578A comprises two engagement pins comprising the first engagement pin 124 that can turn such that releasing action of the inside handle lever 110 with opening action of the inside handle IH can be transmitted and cannot be transmitted to the first link lever 120 and the second engagement pin 155 that can turn such that the releasing action of the inside handle lever 110 can be transmitted or cannot be transmitted to the switch lever 150, thereby increasing the number of structural elements and making its structure complicated.

SUMMARY OF THE INVENTION

In view of the disadvantages, it is an object of the invention to provide a vehicle door operating device in which opening action of an inside handle cannot be transmitted to a door latch device, but can be transmitted to a switch lever when a childproof lock lever is in a childproof lock position wherein the number of structural elements is reduced.

EMBODIMENT FOR CARRYING OUT THE INVENTION

One embodiment of the present invention will be described.

Figure 1:
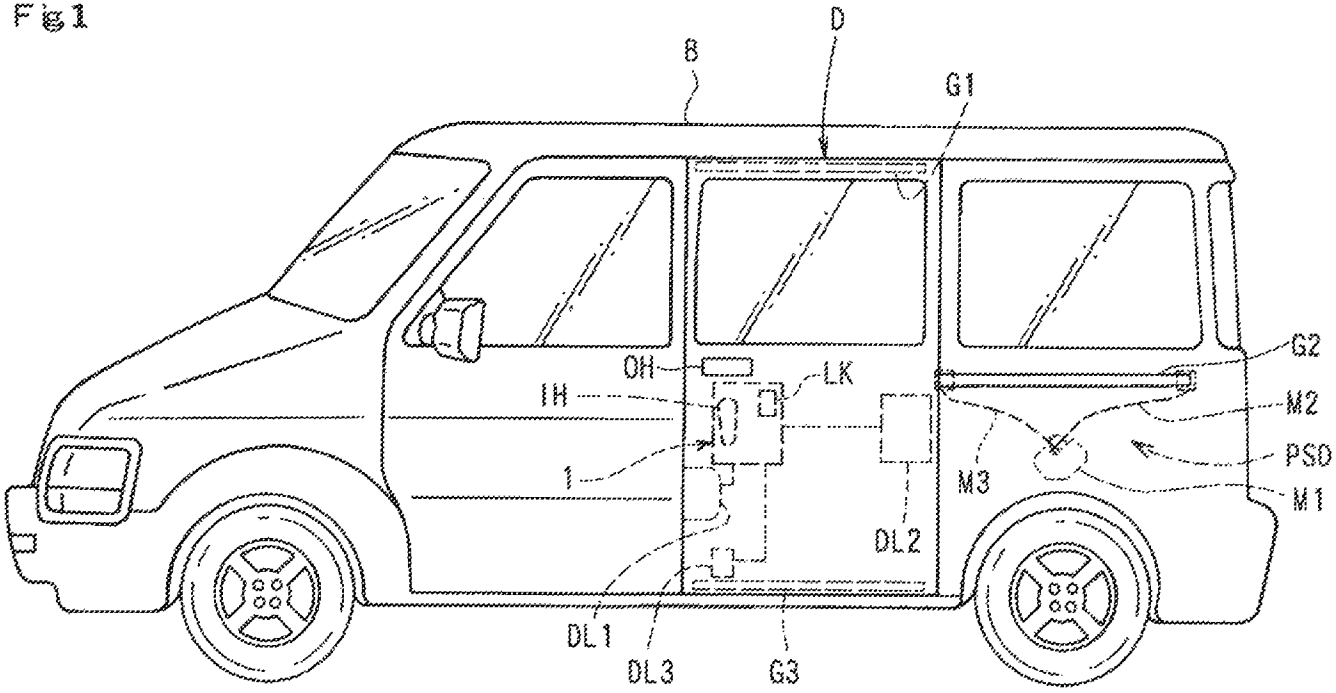
FIG. 1 is a side elevational view of a vehicle to which the present invention is applied.

In FIG. 1, D denotes a sliding door that opens and closes longitudinally along an upper guide rail G1, a waist guide rail G2 and a lower guide rail G3.

On the outer panel of the door D, there is provided an outside handle OH with which a door D is opened and closed outside a vehicle; an inside handle IH with which the door D is opened and closed inside the vehicle; a locking knob LK that changes a locking mechanism (later described) to an unlock state and a lock state manually, on an inner panel of the door D; a fully-open door latch device DL3 that holds the door in a fully-open position at the lower part; a front fully-closed door latch device DL1 that holds the door in a closed position at the front part; and a rear fully-closed door latch device DL2 that holds the door in the closed position with the front fully-closed door latch device DL1. The side of the vehicle body B has an electric door opening device PSD for opening and closing the door D.

Inside the door D, there is provided an operating device 1 interconnecting manual action of the outside handle OH and the inside handle IH.

The fully-closed door latch device DL is known and comprises a latch mechanism (not shown) that engages with a striker (not shown) fixed to the vehicle body to hold the door D in a closed position; a closer mechanism that actuates the latch mechanism from a half-latch state to a full-latch state to forcedly close from an ajar state (where the striker slightly engages with the latch mechanism) to a fully-closed state (where the striker fully engages with the latch mechanism) by an electric force when the door D is closed; a releasing mechanism that disengages the latch mechanism from the striker; and an emergency mechanism that forcedly cuts off a connection between the closer mechanism and the latch mechanism.

The electric door opening device PSD is a known structure that comprises a drive portion M1 that comprises a motor, a reduction mechanism that slows down the motor and a rotary drum that is rotated by the reduction mechanism; and an opening cable M2 and a closing cable M3 that are wound on and reeled out of the rotary drum. Each of the cables M2, M3 is wound on an inversion pulley (not shown) supported on the waist guide rail G2 and is connected to the door D. Power of the motor is transmitted to the door D via the opening cable M2 and the closing cable M3, and the door D is opened and closed.

Figure 2:
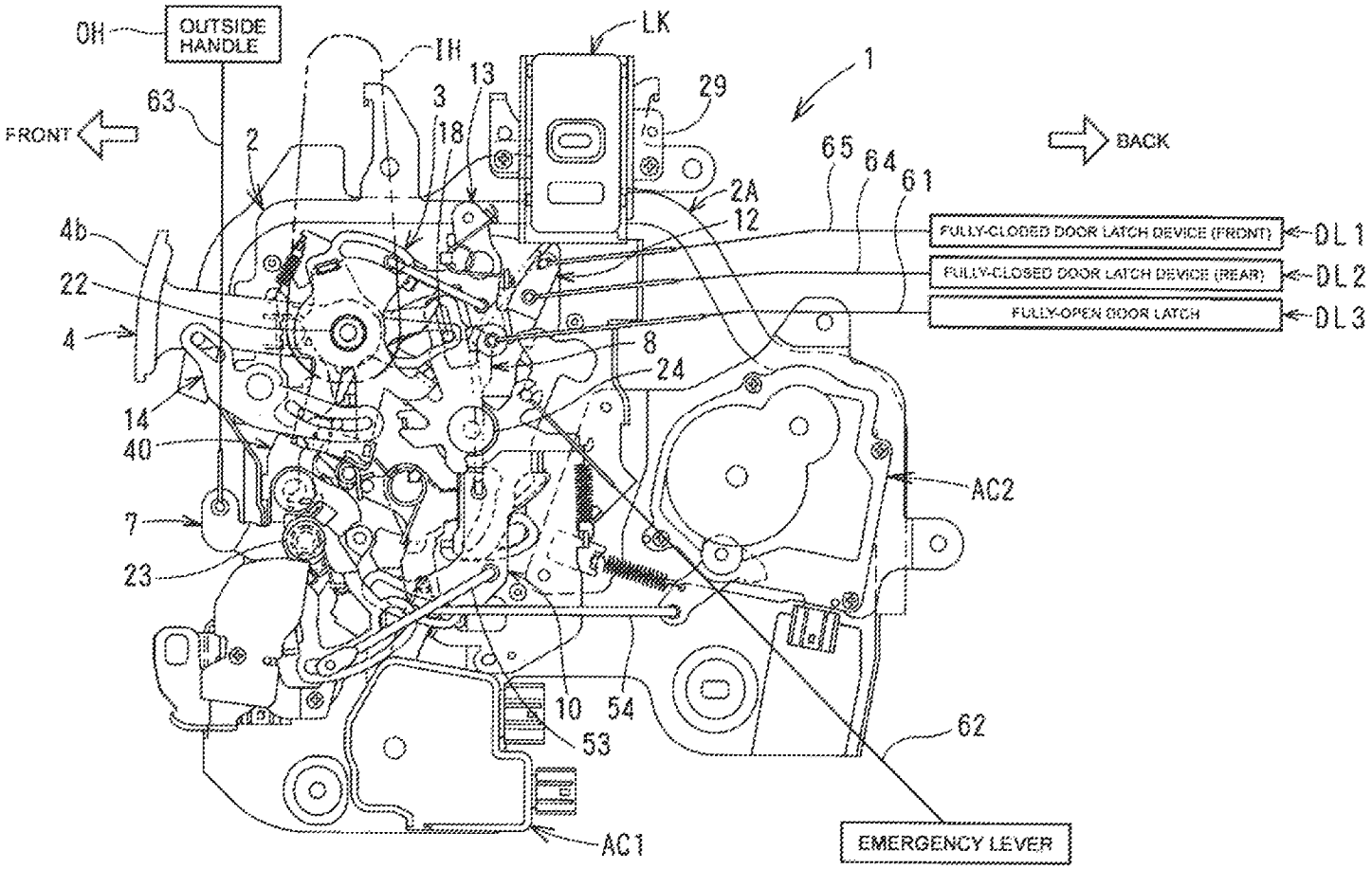
FIG. 2 is a front elevational view of an operating device viewed from the interior of the vehicle.
Figure 3:
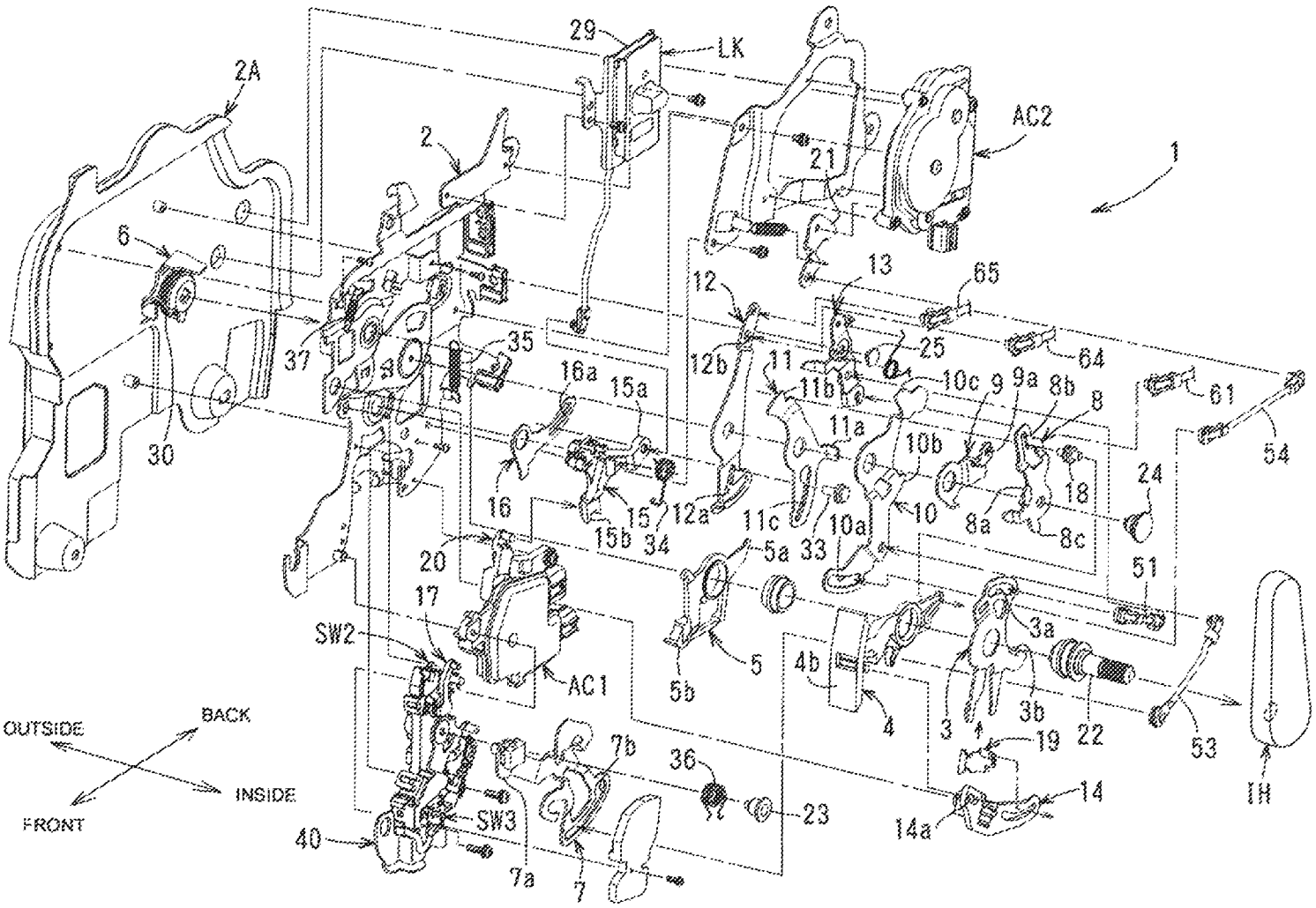
FIG. 3 is an exploded perspective view of the operating device.

In FIGS. 2 and 3, the operating device 1 comprises a base member 2 fixed in the door D. The base member 2 comprises on one side facing the interior of the vehicle the locking knob LK, a locking/unlocking actuator AC1 with an output lever 20 that supplies power of an internal motor; a releasing actuator AC2 with an output lever 21 supplying power of an internal motor; an inside handle shaft 22 that is disposed longitudinally of the vehicle to enable the inside handle IH to pivot; an inside lever 3, a childproof lock lever 4, a switch lever 5 and an inside subsidiary lever 6 which are pivotally mounted via the inside handle shaft 22; an opening inside lever 8, an emergency lever 9, a second outside lever 10, a subsidiary lever 11 and a release lever 12 which are pivotally mounted via a shaft 24 behind the shaft 22; a closing inside lever 26 that is pivotally mounted via a shaft 25 behind the inside handle shaft 22; a childproof lock link 14 that is pivotally mounted via a shaft 26 in front of the inside handle shaft 22; a first lock lever 15 and a second lock lever 16 which are pivotally mounted via a shaft 27 in front of the shaft 24; an inside handle detecting lever 17 that is pivotally mounted via a shaft 28 below the inside handle shaft 22; an inside handle sensor SW1; a childproof sensor SW2; an outside handle sensor SW3; an engagement pin 18 provided in a motion transmitting path between the opening inside lever 8 and the subsidiary lever 11; and a slider 19 that slides on the inside lever 3. A waterproof cover 2A covers the other side of the base member 2.

Figure 4:
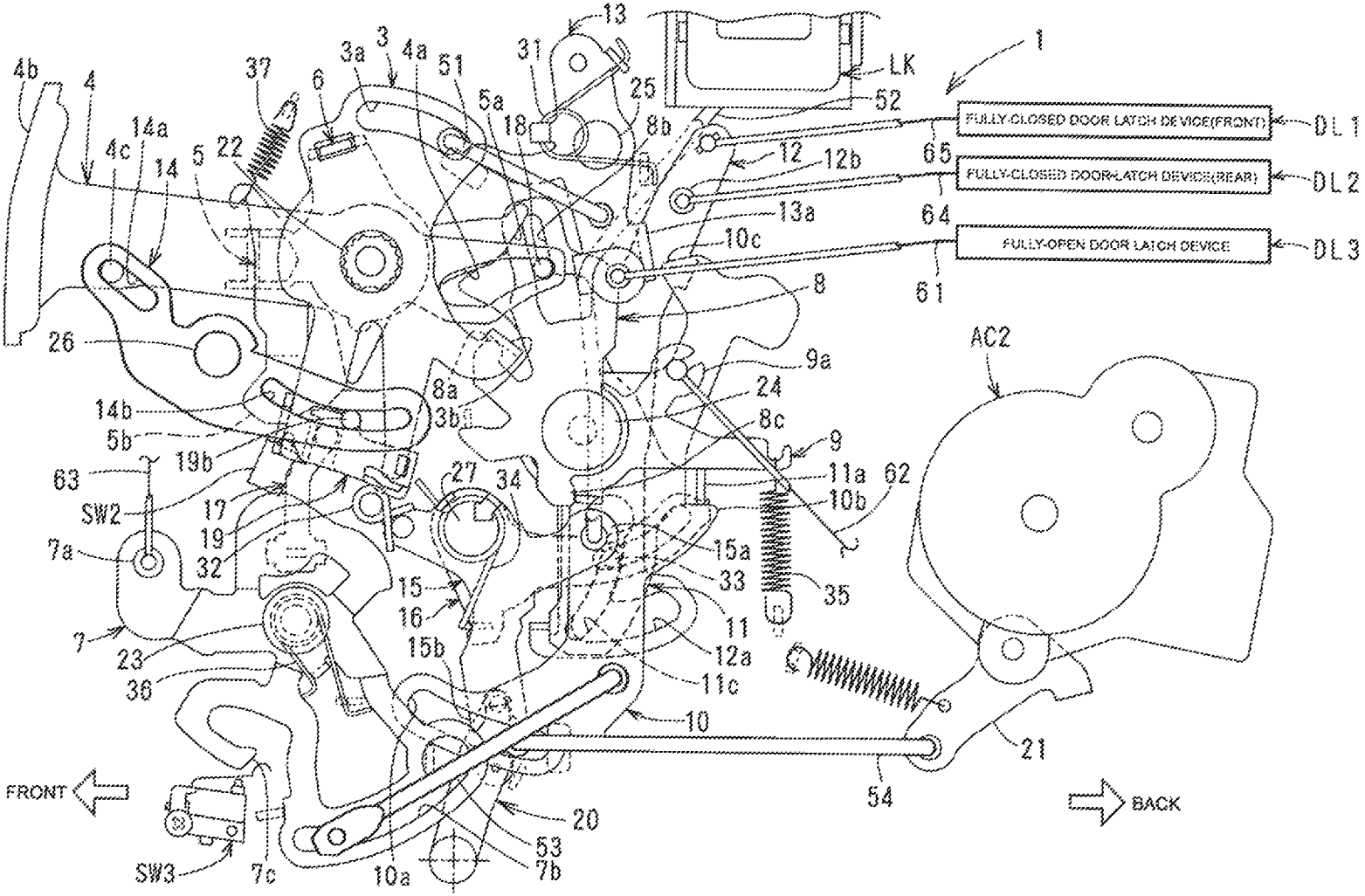
FIG. 4 is a front elevational view of the operating device viewed from the interior of the vehicle, in which a locking mechanism is in an unlock state and a childproof mechanism is in a childproof unlock state.
Figure 6:
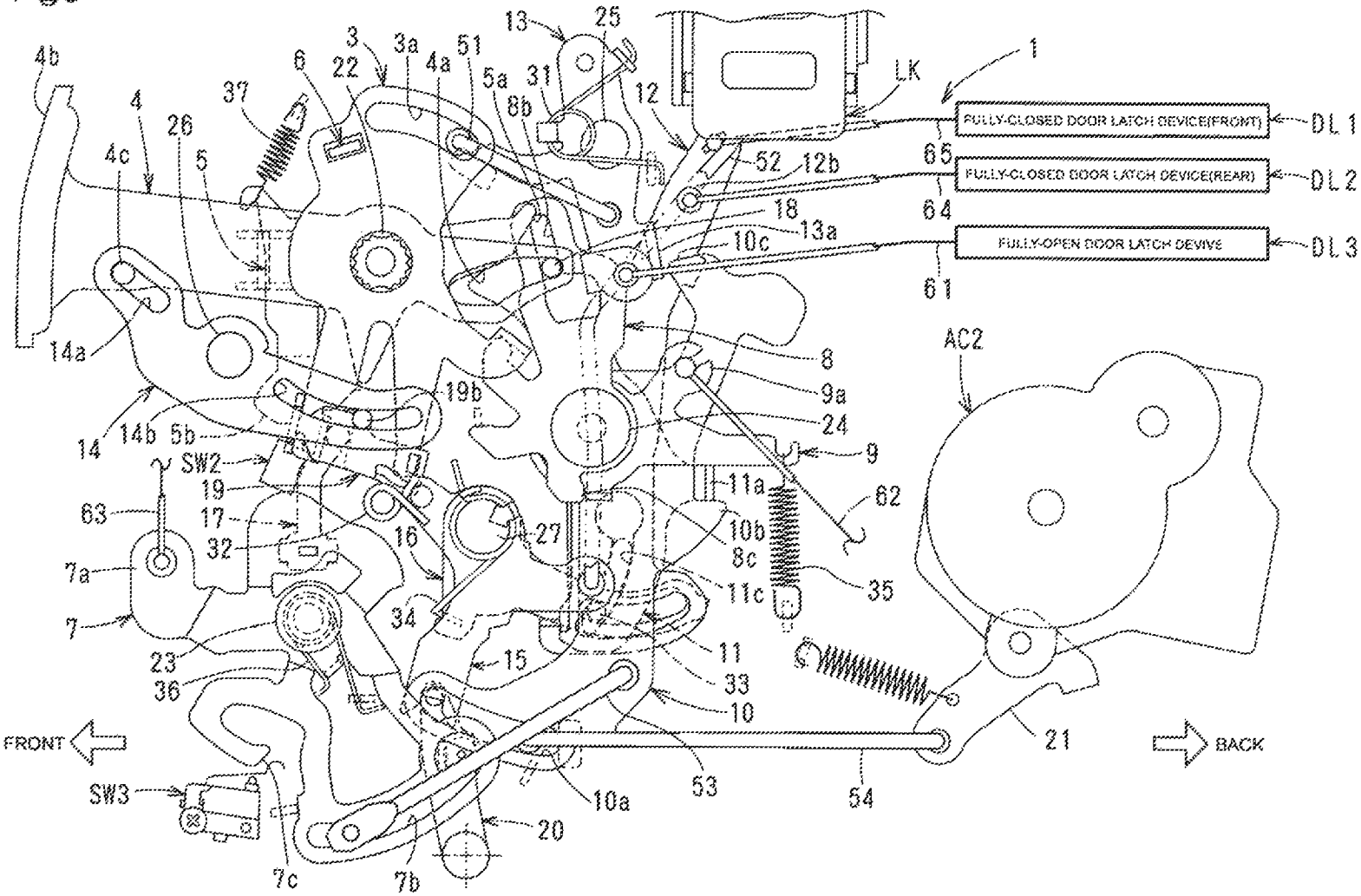
FIG. 6 is a front elevational view of the operating device in which the locking mechanism is in a lock state and the childproof mechanism is in a childproof unlock state.

The locking knob LK is supported to slide vertically along a guide bracket 29 fixed to the upper part of the base member 2 and is movable manually at the interior of the vehicle between an unlock position in FIG. 4 where the locking mechanism is unlocked and a lock position in FIG. 6 where the locking mechanism is locked. The lock position is moved from the unlock position at a certain distance downward.

"The locking mechanism" in this embodiment includes the first and second lock levers 15, 16 and an engagement pin 33 (later described). "The unlock state" means that the door D can be opened by the outside handle OH and the inside handle IH when the first and second lock levers 15, 16 and engagement pin 33 are at an unlock position (later described), and "the lock state" means that the door D cannot be opened by invalidating opening actions of the outside handle OH and the inside handle 1H when the first and second lock levers 15, 16 and engagement pin are at a lock position (later described).

"The childproof mechanism" comprises the childproof lock lever 15, 16 and the engagement pin 18, and "the childproof unlock state" means that the door D can be opened by the inside handle IH when the childproof lock lever 4 and engagement pin 18 are in a childproof unlock position and when the locking mechanism is in the unlock state. "The childproof lock state" means that the door D can be opened by invalidating an opening action of the inside handle IH even when the childproof lock lever 4 and engagement pin 18 are in a childproof lock position (later described) and even when the locking mechanism is in "the unlock state".

The locking mechanism is shifted to the unlock state and lock state by motor power of the locking actuator AC1 in which a motor (not shown) and a reduction gear for slowing down the motor are disposed in a housing fixed to the lower part of the base member, and an output lever 20 for supplying rotation of the reduction gear is pivotally mounted outside the housing. The locking actuator AC1 is operated by locking/unlocking action of a switch in a vehicle or a portable wireless switch.

When the locking mechanism is in the unlock state, the releasing actuator AC2 releases the fully-open door latch device DL3 and fully-closed door latch device DL1, DL2 via various elements by driving a motor thereby enabling the door D to open and close. Within a housing fixed to the rear part of the base member 2, a motor (not shown) and a reduction gear for slowing down rotation of the motor are disposed, and an output lever 21 for supplying rotation of the reduction gear to the outside of the housing is pivotally mounted. The releasing actuator AC2 is actuated by a wireless switch.

The inside handle IH is fixed to the inner end of the inside handle shaft 22 pivotally mounted to the base member 2. In order to open the door D, the inside handle IH swings backward from a neutral position in FIG. 2 through a predetermined angle, and in order to close the door D, it swings forward from the neural position through a predetermined angle.

Figure 10:
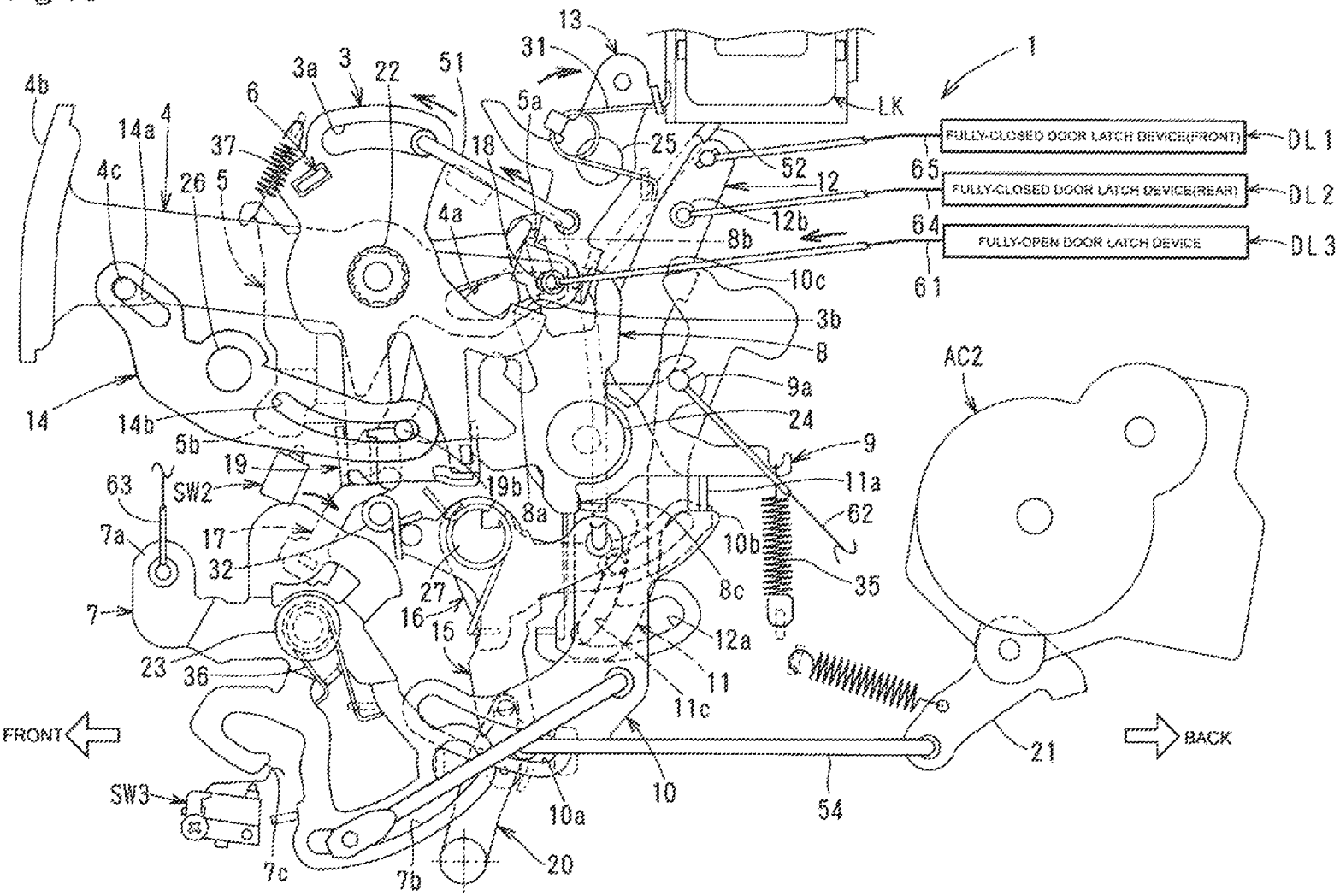
FIG. 10 is a front elevational view of the operating device, wherein an inside handle IH is operated to open the door when the locking mechanism is in an unlock state and the childproof mechanism is in a childproof lock state.

The inside lever 3 is pivotally mounted at the upper part of the base member 2 via the inside handle shaft 22 to rotate with the inside handle IH and inside subsidiary lever 6, and is held at a neutral position in FIG. 4 by a spring 30 which acts on the inside subsidiary lever 6 at its initial time when nothing is actuated. The inside lever 3 is moved against the spring 30 clockwise in FIG. 8 from the neutral position in FIG. 4 by opening action of the inside handle IH and moved counterclockwise from its neutral position as shown in FIG. 10 by closing action.

Furthermore, the front end of a connecting rod 51 coupled to the closing inside lever 13 slides in an arcuate elongate hole 3*a* in the upper part of the inside lever 3 longitudinally of the vehicle. Closing action of the inside handle IH can be transmitted to the closing inside lever 13 via the connecting rod 51. A bent portion 3*b* of the inside handle 111 comes in contact with a contact portion 8*a* of the opening inside lever 8 from above. Thus, the opening inside lever 8 is released counterclockwise in FIG. 8.

The slider 19 is supported to move up and down under the inside lever 3. The slider 19 follows motion of the childproof lock lever 4 as described below, is in a childproof unlock position where the slider 19 is within a moving path of the upper end 17*a* of the inside handle detecting lever 17 when the childproof lock lever 4 is in a childproof unlock position in FIG. 12, and is in a childproof lock position where the slider 19 moves upward from the childproof unlock position and is off a moving path of the upper end 17*a*.

Figure 5:
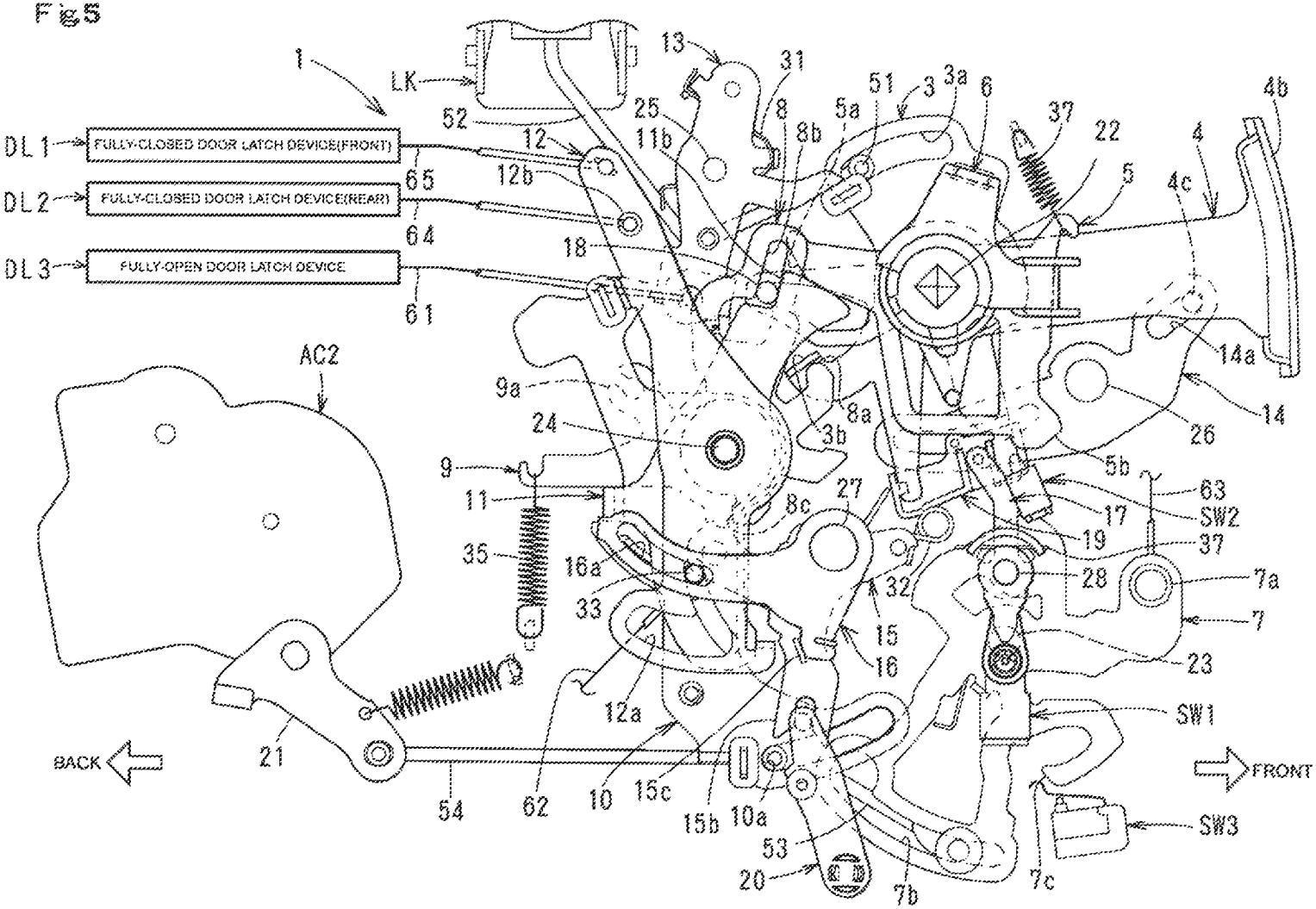
FIG. 5 is a back elevational view of the operating device viewed from the interior of the vehicle, being the same state as that in FIG. 4.

The inside handle detecting lever 17 is pivotally mounted via a shaft 28 to a switch case 40 fixed to the lower part of the base member 2 and can pivot against the spring 37 (in FIG. 5) clockwise (counterclockwise in FIG. 5) from the neutral position in FIGS. 4 and 5. The pivoting is transmitted to the inside handle sensor SW1.

The inside handle sensor SW1 is disposed in the switch case 40 and is turned on by transmitting clockwise or counterclockwise rotation of the inside handle detecting lever 17 from the neutral position. The inside handle sensor SW1 transmits to a control in the vehicle an opening or closing signal triggering the electric door opening device PSD.

The control receives the opening signal from the inside handle sensor SW1 to control the electric door opening device PSD in an opening direction, and receives the closing signal to control the electric door opening device PSD in a closing direction.

Figure 12:
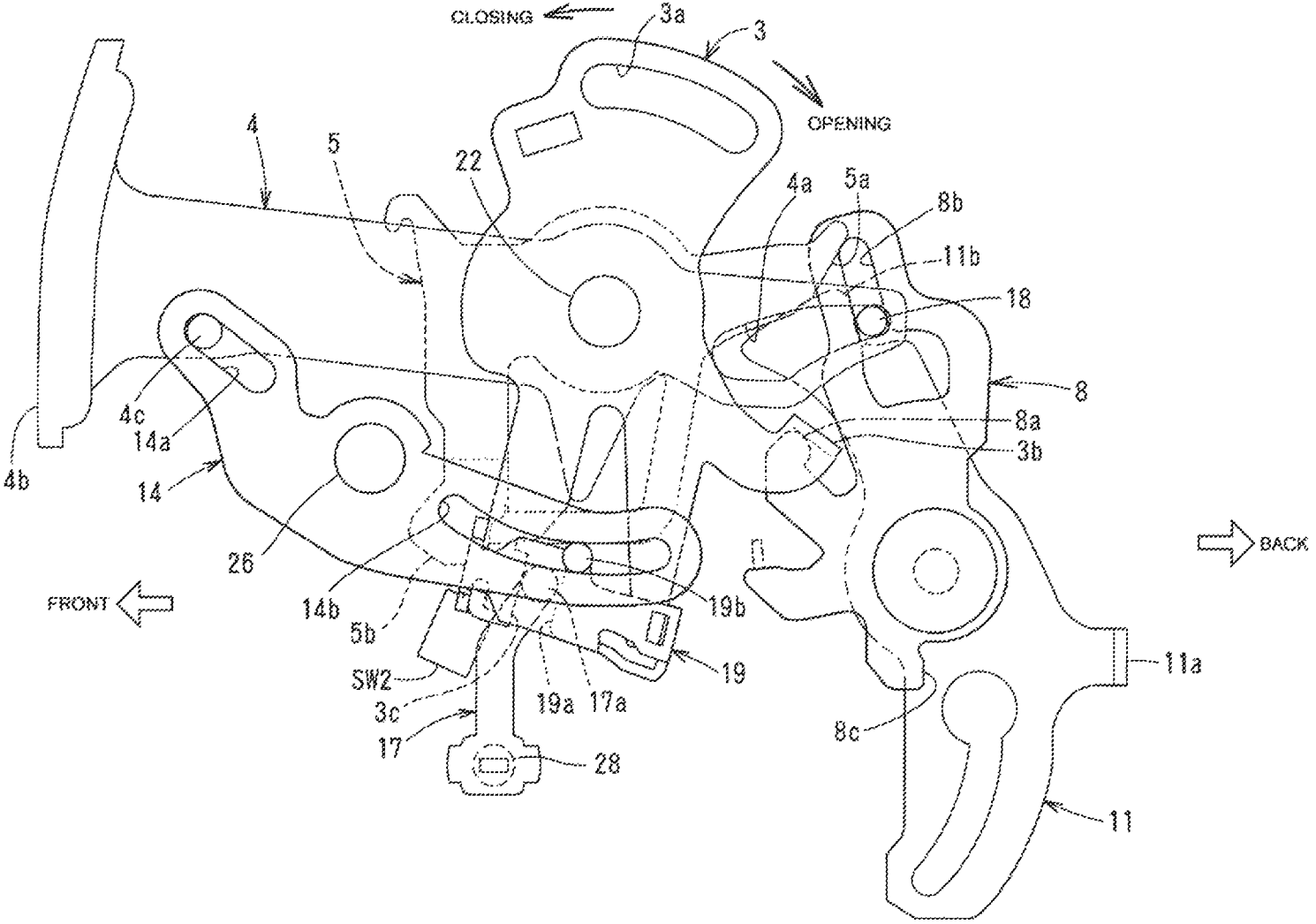
FIG. 12 is an enlarged front elevational view when the childproof mechanism is in a childproof unlock state.

In FIGS. 4 and 12, when the slider 19 is in the childproof unlock position or when the childproof mechanism is in the childproof unlock position, a contact portion 19*a* of the slider 19 comes in contact with an upper end 17*a* of the inside handle detecting lever 17 from back owing to opening action of the inside lever 3. The inside handle detecting lever 17 is rotated through a predetermined angle counterclockwise from the neutral position in FIGS. 4 and 12 thereby turning on the inside handle sensor SW1. With closing action of the inside lever 3, a contact portion 3*c* at the lower part of the inside lever 3 comes in contact with the upper end 17*a* from front. The inside handle detecting lever 17 is rotated clockwise from the neutral position through a predetermined angle thereby turning the inside handle sensor SW1 on.

Figure 7:
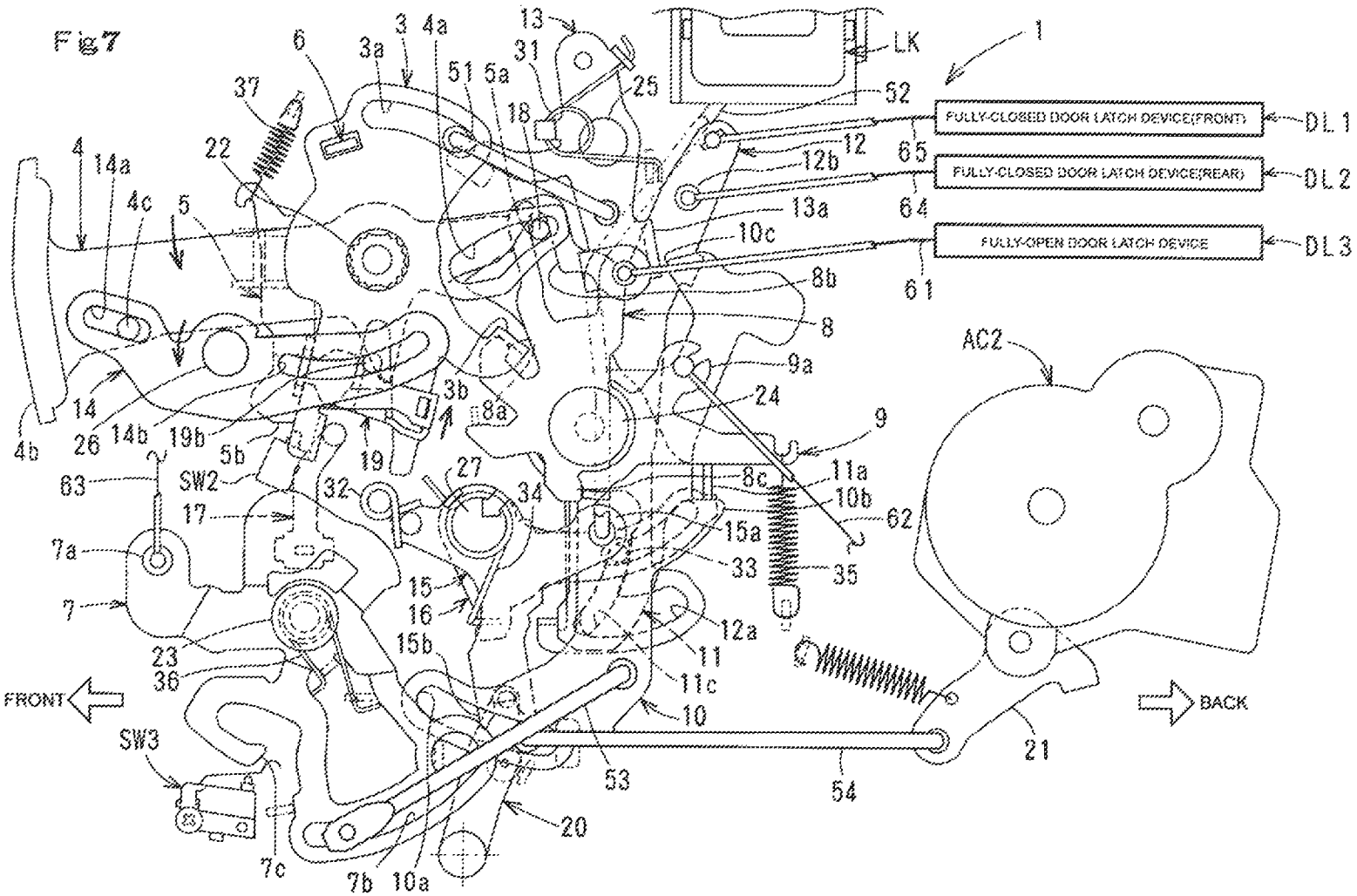
FIG. 7 is a front elevational view of the operating device in which the locking mechanism is in an unlock state and the childproof mechanism is in a childproof lock state.
Figure 13:
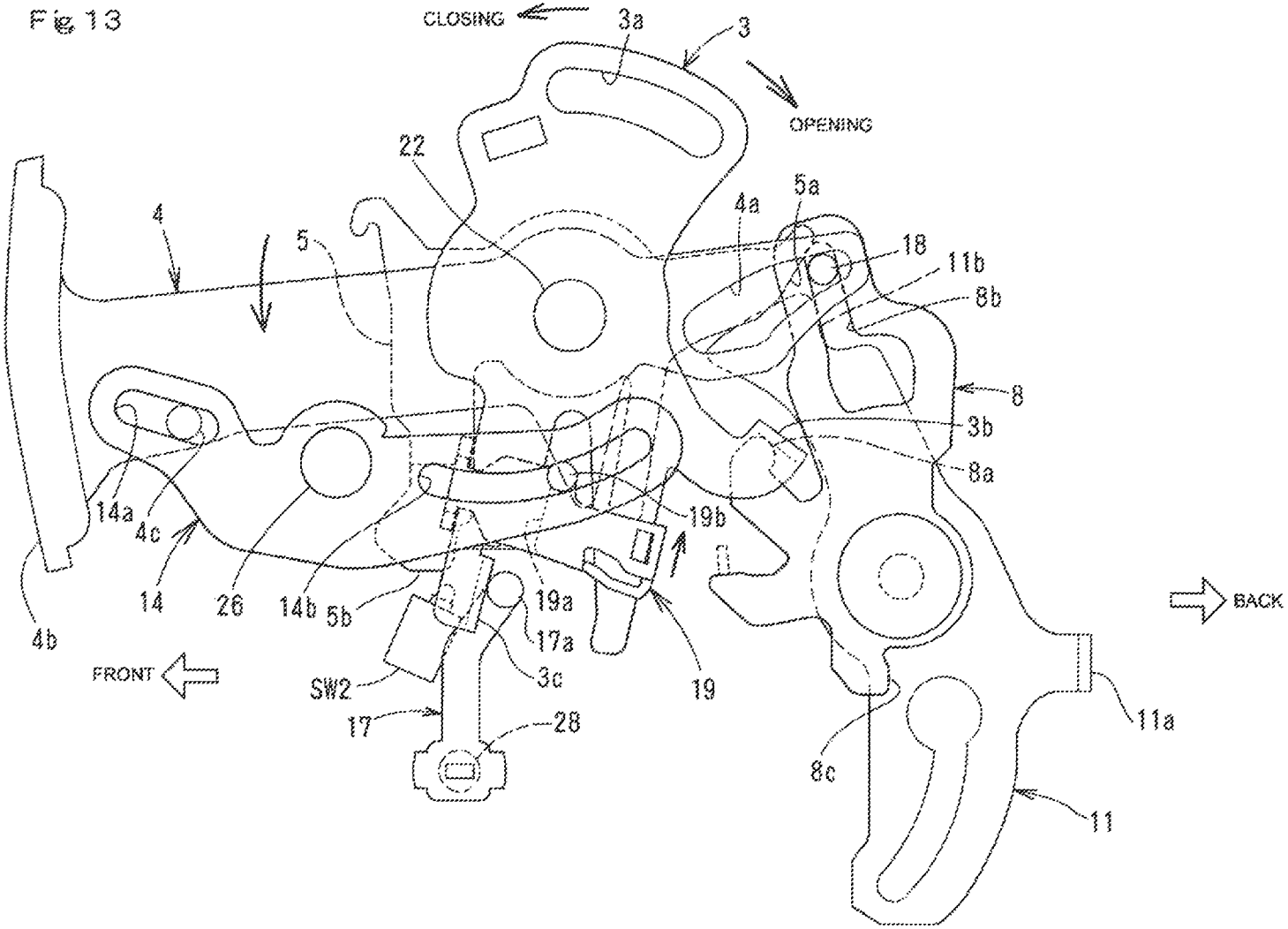
FIG. 13 is an enlarged front elevational view when the childproof mechanism is in a childproof lock state.

In FIGS. 7 and 13, when the slider 19 is in the childproof lock position or when the childproof mechanism is in the childproof lock state, the slider 19 is out of the moving path of the upper end 17*a* of the inside handle detecting lever 17. Thus, even if the inside lever 3 is operated to open the door, the inside handle detecting lever 17 is held in the neutral position and does not turn the inside handle sensor SW1 on and off. When the inside lever 3 is operated to close the door, the contact portion 3*c* of the inside lever 3 comes in contact with the upper end 17*a* from front, so that the inside handle detecting lever 17 is rotated from the neutral position through a predetermined angle thereby turning the inside handle sensor SW1 on.

Specifically, when the childproof mechanism is in the childproof unlock state, the inside handle sensor SW1 is capable of transmitting to the control a signal triggering the electric door opening device PSD by turning on owing to opening or closing action of the inside lever 3. When the inside handle sensor SW1 is in the childproof lock state, the inside handle sensor SW1 is not capable of transmitting a signal that triggers the electric door opening device PSD owing to opening action of the inside lever 3, but is capable of transmitting to the control a signal that triggers the electric door opening device PSD only owing to opening action.

The closing inside lever 13 is pivotally mounted via a shaft 25 to the base member 2 and is connected in the elongate hole 3*a* of the inside lever 3 via the connecting rod 51. A contact portion 10*c* (later described) of the second outside lever 10 is capable of contacting the bent portion 13*a*. The lowest portion of the closing inside lever 13 is connected to a fully-open door latch device DL3 via a motion-transmitting member 61. Thus, the closing inside lever 13 is released in FIG. 10 clockwise from the initial position in FIG. 4 by closing action of the inside handle IH and inside lever 3 and by releasing action of the second outside lever 10 with the outside handle OH.

When the fully-open door latch device DL3 engages with the striker to hold the door D in the fully-open position, the closing inside lever 13 is operated for releasing in FIG. 10 by closing action of the inside handle IH, the releasing action is transmitted to the fully-open door latch device DL3 via the motion-transmitting member 61. The fully-open door latch device DL3 disengages from the striker to enable the door D to move in a closing direction. When the inside lever 3 is operated to close the inside lever 3 owing to closing action of the inside handle IH, the bent portion 3*b* of the inside lever 3 moves away from the contact portion 8*a* of the opening inside lever 8, so that the closing action of the inside lever 3 is not transmitted to the opening inside lever 8.

Figure 8:
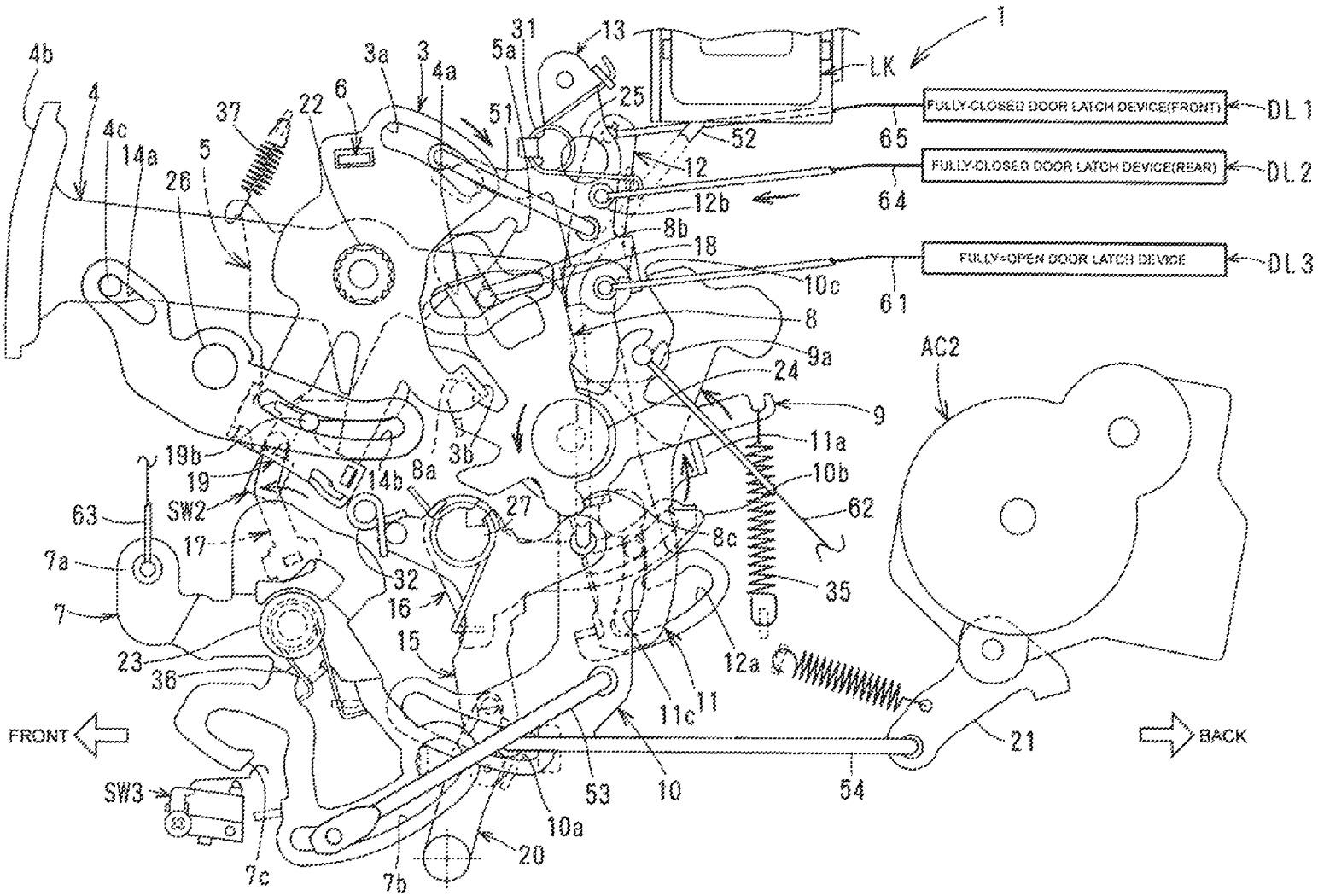
FIG. 8 is a front elevational view of the operating device, wherein an inside handle IH is operated to open the door when the locking mechanism is in an unlock state and the childproof mechanism is in a childproof unlock state.

The opening inside lever 8 is pivotally mounted to the base member 2 via the shaft 24 and the bent portion 3*b* comes in contact with the contact portion 8*a* from above with clockwise opening action of the inside lever 3 and is operated for releasing counterclockwise from the initial position in FIG. 4 with opening action of the inside lever 3 in FIG. 8.

In FIG. 8, the releasing action of the opening inside lever 8 is transmitted to the emergency lever 9 by making the contact portion 8*c* at the lower part contact a part of the emergency lever 9. When the childproof mechanism is in the childproof unlock state, the releasing action is transmitted to the subsidiary lever 11 via the engagement pin 18, and when the childproof mechanism is in the childproof lock state, it is not transmitted to the subsidiary lever 11.

A vertical elongate hole 8*b* is formed in the upper part of the opening inside lever 8. When the childproof lock lever 4 is in the childproof unlock position, the engagement pin 18 moves in the elongate hole 8*b* between the childproof unlock position where the releasing action of the opening inside lever 8 can be transmitted to the subsidiary lever 11 in FIGS. 4 and 12 and the childproof lock position where it cannot be transmitted in FIGS. 7 and 13.

In FIGS. 12 and 13, the engagement pin 18 slides in a horizontal elongate hole 4*a* at the rear part of the childproof lock lever 4 and in the vertical elongate hole 8*b* of the opening inside lever 8. Thus, when the childproof lock lever 4 is in the childproof unlock position in FIG. 12, the engagement pin 18 is in the childproof unlock position where the engagement pin 18 faces the contact portion 11*b* at the upper part of the subsidiary lever 11, the engagement pin 18 moves forward with releasing action of the opening inside lever 8 and comes in contact with the contact portion 11*b* from back, thereby transmitting releasing action of the opening inside lever 8 to the subsidiary lever 11. When the childproof lock lever 4 moves to the childproof lock position, the engagement pin 18 moves upward from unlock position and does not face the contact portion 11*b*. Even if the engagement pin 18 moves forward with releasing action of the opening inside lever 8, the engagement pin 18 does not come in contact with the contact portion 11*b* and the releasing action of the opening inside lever 8 is not transmitted to the subsidiary lever 11.

The emergency lever 9 is pivotally mounted to the base member 2 via the shaft 24, and a connecting portion 9*a* at the end is connected to an emergency mechanism (emergency lever) of the fully-closed door latch device DL2 via a motion transmitting member 62. Whether the lock mechanism is in the unlock state or lock state, based on opening action of the outside handle OH or inside handle IH described later, the emergency lever 9 is moved for releasing counterclockwise against the spring 35 from the initial position in FIG. 4 to FIG. 8, and the releasing action is transmitted to the emergency mechanism of the fully-closed door latch device DL2 via the motion transmitting member 62. The emergency mechanism stops the closing action by cutting off a transmitting path between the closer mechanism and the latch mechanism of the fully-closed door latch device DL2.

A first outside lever 7 is pivotally mounted to the switch case 40 via a shaft 23. A connecting portion 7*a* at the front end is connected to the lower end of a vertical motion transmitting member 63 the upper end of which is coupled to the outside handle OH. The front end of a connecting rod 53 the rear end of which is coupled to a second outside lever 10 slides in and along an elongate hole 7*b* at the lower part. The motion transmitting member 63 is moved downward by the outside handle OH, and the first outside lever 7 is moved counterclockwise from its initial position in FIG. 4 against the spring 36. The releasing action is transmitted to the second outside lever 10 via the connecting rod 53.

With the releasing action of the first outside lever 7, an outside handle sensor SW3 turns on by contacting a detecting portion 7*c* at the lower part of the first outside lever 7. When the locking mechanism is in the unlock state, the control controls the releasing actuator AC2 with an ON signal from the outside handle sensor SW3, and control the electric-door opening device PSD. When the locking mechanism is in the lock state, if a portable key of a driver is communicated to ECU (Electric Control Unit), the control controls the locking actuator AC1 to turn the locking mechanism to the unlock state based on an opening signal of the outside handle sensor SW3, and controls the releasing actuator AC2 and electric-door opening device PSD. If the portable key is not communicated, no reaction occurs even if an on signal is received from the outside handle sensor SW3.

A second outside lever 10 is pivotally mounted to the base member 2 via the shaft 24. A connecting rod 54 coupled to an output lever 21 of the releasing actuator AC2 is slidably connected to an elongate hole 10*a* at the lower part of the second outside lever 10. The second outside lever 10 performs releasing action counterclockwise against the spring 35 from its initial position in FIG. 4 with action of the output lever 21 owing to drive of the releasing actuator AC2 (counterclockwise rotation in FIG. 4) and releasing action of the first outside lever 7.

A pawl 10*b* of the second outside lever 10 comes in contact with the bent portion 11*a* of the subsidiary lever 1, so that releasing action of the second outside lever 10 is transmitted to the subsidiary lever 11. A contact portion 10*c* at the upper end comes in contact with the bent portion 13*a* of the closing inside lever 13 from back, so that the releasing action of the second outside lever 10 is transmitted to the closing inside lever 13 to put the closing inside lever 13 under releasing action.

When releasing action of the second outside lever 10 is performed with releasing action of the first outside lever 7, the front end of the connecting rod 54 is relatively moved in the elongate hole 10*a* of the second outside lever 10, and the releasing action of the second outside lever 10 is not transmitted to the output lever 21 of the releasing actuator AC2. When releasing action of the second outside lever 10 is performed based on drive of the releasing actuator AC2, the front end of the connecting rod 53 is relatively moved in the elongate hole 7*b* of the first outside lever 7, so that the releasing action of the second outside lever 7 is not transmitted to the first outside lever 7.

The subsidiary lever 11 is pivotally mounted to the base member 2 via the shaft 24. The pawl 10*b* of the second outside lever 10 comes in contact with the bent portion 11*a* of the subsidiary lever 11 from below. The subsidiary lever 11 is actuated for releasing the engagement counterclockwise against the spring 35 from its initial position in FIG. 4 with releasing action of the second outside lever 10 based on opening action of the outside handle OH.

In FIG. 4, the childproof lock lever 4 and engagement pin 18 are in the childproof unlock position, the engagement pin 19 comes in contact with the contact portion 11*b* of the subsidiary lever 11 from back owing to forward motion of the engagement pin 18 with releasing action of the opening inside lever 8, and releasing action of the opening inside lever 8 is transmitted to the subsidiary lever 11. The subsidiary lever 11 performs releasing action like opening action of the outside handle OH. Meanwhile, in FIG. 7, when the childproof lock lever 4 and engagement pin 18 are in the childproof lock position, the engagement pin 18 cannot come in contact with the contact portion 11*b*, so that the releasing action of the opening inside lever 8 is not transmitted to the subsidiary lever 11.

In the lower part of the subsidiary lever 11, there is formed a vertical elongate hole 11*c* in which an engagement pin 33 that is part of the locking mechanism fits.

In addition to the elongate hole 11*c* of the subsidiary lever 11, the engagement pin 33 slidably fits in an L-shaped control hole 12*a* that comprises a vertical portion and a horizontal portion which communicates with the lower end of the vertical portion of the release lever 12, and in an elongate hole 16*a* of the second lock lever 16. When the second lock lever 16 is in the unlock position in FIG. 4, the engagement pin 33 fits in the vertical portion of the control hole 12*a* and in an unlock position where releasing action of the subsidiary lever 1 can be transmitted to the release lever 12, and when the second lock lever 16 moves to the lock position, the engagement pin 33 is in the horizontal portion of the control hole 12*a* in FIG. 6 and moves to the lock position where releasing action of the subsidiary lever 11 cannot be transmitted to the release lever 12.

The release lever 12 is pivotally mounted to the base member 2 via the shaft 24. A connecting portion 12*b* at the upper part is connected to a release mechanism of the fully-closed door latch device DL2 via a motion transmitting member 64, and to a release mechanism of the fully-closed door latch device DL1. When the engagement pin 33 in the control hole 12*a* and the first and second lock lever 15, 15 are in an unlock position and the locking mechanism is in an unlock state in FIG. 4, the subsidiary lever 11 is moved with releasing action counterclockwise from its initial position to FIG. 8. When the engagement pin 33 and the first and second lock lever 15, 16 are in a lock position and the locking mechanism is in an lock state, the engagement pin 33 relatively moves through the horizontal portion of the control hole 12 even if the subsidiary lever 12 moves for releasing and does not move from its initial position. When the release lever 12 is moved for releasing, the releasing action is transmitted to the fully-closed door latch devices DL2, DL1 via the motion transmitting members 64, 65, so that the fully-closed door latch devices DL2, DL1 are released thereby enabling the door D to open from the fully-closed position.

The first lock lever 15 is pivotally mounted to the base member 2 via the shaft 27 at a surface of the base member 2 facing the interior of the vehicle. A connecting portion 15*a* at the rear end is connected to the locking knob LK via a vertical connecting rod 52 and a connecting portion 15*b* of the lower end is connected to the upper end of the output lever 20 of the locking actuator AC1. With manual operation of the locking knob LK and action of the output lever 20 made by power of the locking actuator AC1, the first lock lever 15 moves against a turnover spring 32 supported on the base member 2 to the unlock position in FIG. 4 where opening action of the outside handle OH and inside handle IH is validated and to a lock position in FIG. 6 where it is invalidated.

The second lock lever 16 is pivotally mounted via the shaft 27 with the first lock lever 15 on a surface of the base member 2 facing the interior of the vehicle. When the first lock lever 15 is moved from the unlock position to the lock position with manual operation of the locking knob LK or electric operation of the locking actuator AC1, the second lock lever 16 comes in contact with a projection 15*c* of the first lock lever 15 in FIG. 5 and is thus moved with the first lock lever 15 from the unlock position to the lock position. When the first lock lever 15 moves from the lock position to the unlock position, the second lock lever 16 moves in an unlocking direction with the first lock lever 15 within force of a spring 34 one end of which engages with the first lock lever 15 and the other end of which engages with the second lock lever 16. The force of the spring 34 that acts between the first lock lever 15 and the second lock lever 16 is set to be smaller than a force of the turnover spring 32.

The second lock lever 16 has the elongate hole 16*a* in which the engagement pin 33 slides longitudinally of the vehicle. As mentioned above, when the second lock lever 16 is in the unlock position, the engagement pin 33 is in the unlock position where the engagement pin 33 is in the vertical portion of the control hole 12 in FIG. 4, and when the second lock lever 16 moves to the lock position, the engagement pin 33 is in the horizontal portion of the control hole 12 in the lock position.

When the engagement pin 33 is in the unlock position in FIG. 8, the engagement pin 33 comes in contact with the vertical portion of the control hole 12 counterclockwise owing to releasing action of the subsidiary lever 11 thereby enabling the releasing action of the subsidiary lever 11 to be transmitted to the release lever 12, while, when the engagement pin 33 is in the lock position, the engagement pin 33 relatively moves along the horizontal portion of the control hole 12, so that the releasing action of the subsidiary lever 11 is not transmitted to the release lever 12. Therefore, when the lock mechanism is in the unlock state, according to opening action of the outside handle OH and inside handle IH, the fully-closed door latch device DL2, DL1 are released, so that the door D can be opened, while, when the lock mechanism is in the lock state, the door D cannot be opened according to opening action of the outside handle OH and inside handle IH.

The childproof lock lever 4 is pivotally mounted to the base member 2 via the inside handle shaft 22 and has an operating portion 4*b* at the front end and the elongate hole 4*a* in which the engagement pin is put to move longitudinally of the vehicle. While the door D is left open, the operating portion 4*b* is locked (downward in FIG. 4) and the childproof lock lever 4 pivots counterclockwise through a predetermined angle around the shaft 22 to move to the childproof lock position in FIG. 7. In FIG. 7, the operating portion 4*b* is unlocked upward, and the childproof lock lever 4 pivots clockwise through a predetermined angle around the shaft 22 from the childproof lock position in FIG. 7 to move to the childproof unlock position in FIG. 4.

The switch lever 5 is pivotally mounted to the base member 2 via the inside handle shaft 22 and has a contact portion 5*a* at the end of an arm extending rearward and a detected portion 5*b* detected by the childproof sensor SW2.

When the childproof lock lever 4 is in the childproof unlock position, the engagement pin 18 is in the childproof unlock position in FIGS. 4 and 12 where the engagement pin 18 can come in contact with the contact portion 11*b* of the subsidiary lever 11 from back and cannot come in contact with the contact portion 5*a* of the switch lever 5. When the childproof lock lever 4 is in the lock position, the engagement pin 18 is in the childproof lock position in FIGS. 7 and 13 where the engagement pin 19 cannot come in contact with the contact portion 11*b* of the subsidiary lever 11 and can come in contact with the contact portion 5*a* of the switch lever 5.

Accordingly, the releasing action of the opening inside lever 8 can be transmitted to the subsidiary lever 11 via the engagement pin 18, but cannot be transmitted to the switch lever 5 when the childproof lock lever 4 is in the childproof unlock position. The releasing action of the opening inside lever 8 cannot be transmitted to the subsidiary lever 11, but can be transmitted to the switch lever 5 via the engagement pin 18 when the childproof lock lever 4 is in the childproof lock position.

Figure 9:
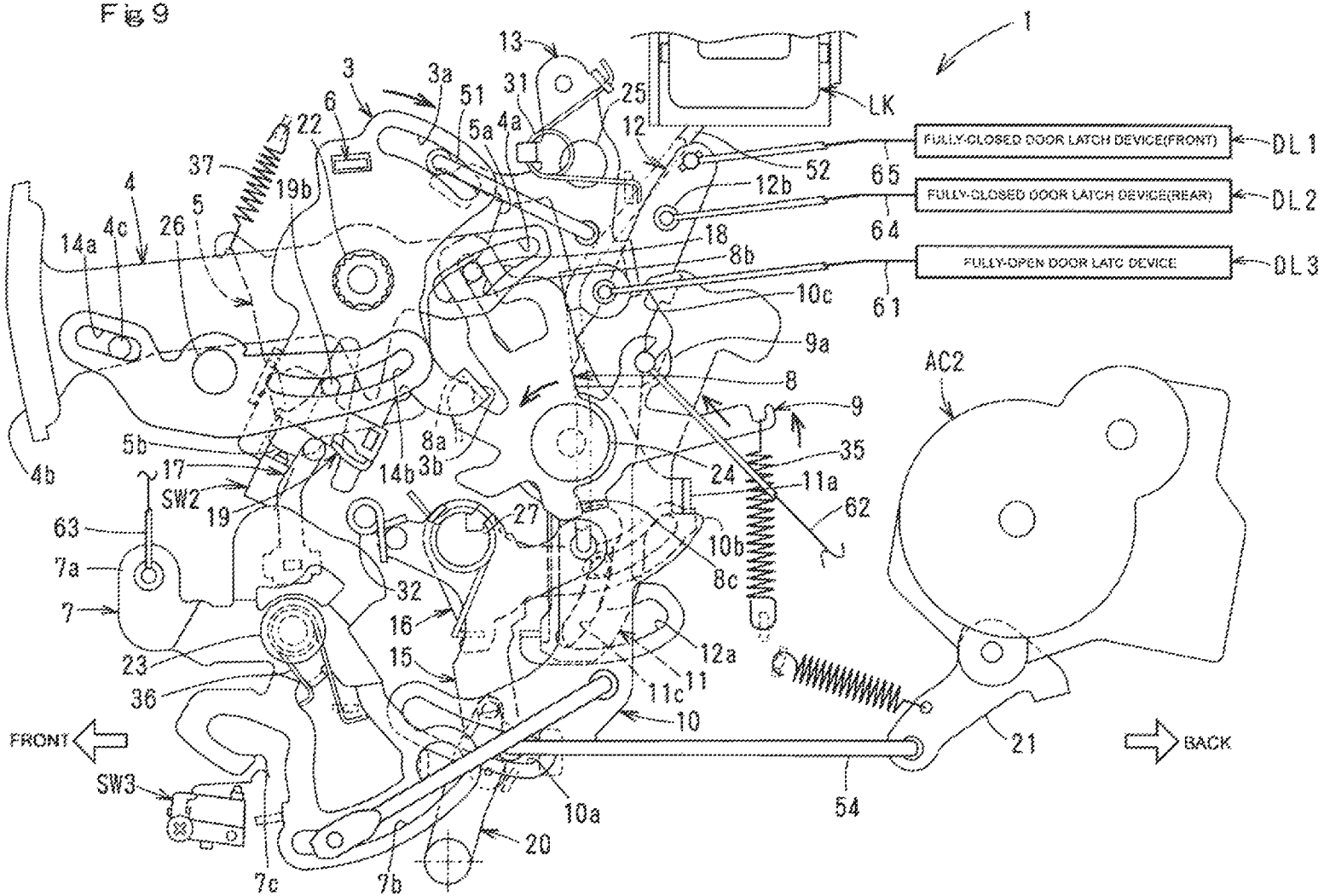
FIG. 9 is a front elevational view of the operating device, wherein an inside handle IH is operated to open the door when the locking mechanism is in an unlock state and the childproof mechanism is in a childproof lock state.

The releasing action of the opening inside lever 8 is transmitted to the switch lever 5 via the engagement pin 18 and is pivoted counterclockwise against the spring 37 from its initial position in FIGS. 4 and 12 to FIG. 9.

The childproof sensor SW2 is disposed in the switch case 40 and is usually off. When the childproof mechanism is in the childproof lock state, the switch lever 5 is pivoted to FIG. 9 and the detected portion 5*b* of the switch lever 5 comes in contact with the childproof sensor SW2, which turns on. The on signal is transmitted to the control.

The childproof lock link 14 is pivotally mounted to the base member 2 via the shaft 26. An elongate hole 14*a* at the front part is joined to a joining portion 4*c* of the childproof lock lever 4, and an elongate hole 14*b* is joined to a joining portion 19*b* of the slider 19. When the childproof lock lever 4 is in the childproof unlock position, the childproof lock link 14 is in a childproof unlock position where the slider 19 is in a childproof unlock position in FIGS. 4 and 12. When the childproof lock lever 14 moves to the childproof lock position, the childproof lock link 14 pivots counterclockwise through a predetermined angle around the shaft 26 and moves to the childproof lock position moving the slider 19 to the childproof lock position in FIGS. 7 and 13. The childproof lock link 14 provides function for transmitting rotation of the childproof lock lever 4 to each position to the slider 19.

Motion of the operating device 1 in the embodiment will be described with FIGS. 4 to 13.

Figure 11:
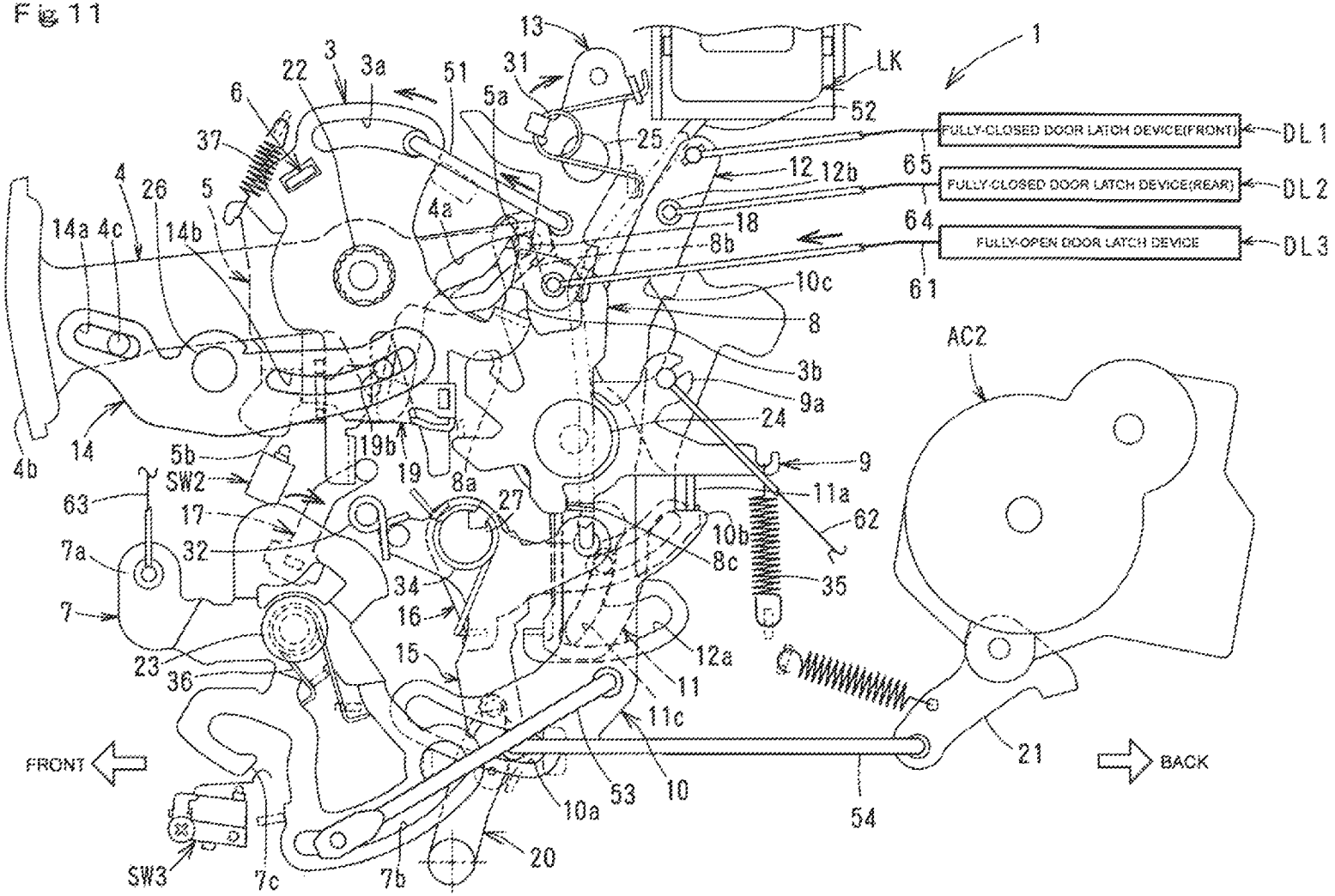
FIG. 11 is a front elevational view of the operating device, wherein an inside handle 1H is operated to close the door when the locking mechanism is in an unlock state and the childproof mechanism is in a childproof unlock state.

FIG. 4 is a front elevational view viewed from the interior of the vehicle when the lock mechanism is in the unlock state and the childproof mechanism is in the childproof unlock state; FIG. 5 is a back elevational view of FIG. 4; FIG. 6 is a front elevational view when the lock mechanism is in the lock state and the child mechanism is in the childproof unlock state; FIG. 7 is a front elevational view when the lock mechanism is in the unlock state and the childproof mechanism is in the childproof is in the childproof lock state; FIG. 8 is a front elevational view when the lock mechanism is in the unlock state, the childproof mechanism is in the childproof unlock state and the inside handle opens the door; FIG. 9 is a front elevational view when the lock mechanism is in the unlock state, the child mechanism is in the childproof lock state and the inside handle opens the door; FIG. 10 is a front elevational view when the lock mechanism is in the unlock state, the child mechanism is in the childproof unlock state and the inside handle open the door; FIG. 11 is a front elevational view when the lock mechanism is in the unlock state, the child mechanism is in the childproof lock state and the inside handle IH closes the door; FIG. 12 is an enlarged front elevational view of the main part when the childproof mechanism is in the childproof unlock state; and FIG. 13 is an enlarged from elevational view when the childproof mechanism is in the childproof lock state.

The Outside Handle OH is Operated to Open the Fully-Closed Door D in FIG. 4

The outside handle OH is operated to open the door in FIG. 4. Opening action is transmitted to the first outside lever 7 via the motion transmitting member 63. Accordingly, the first outside lever 7 is pivoted counterclockwise around the shaft 23 to perform releasing the engagement. Releasing action is transmitted to the second outside lever 7 via the connecting rod 53, and the detected portion 7*c* comes in contact with the outside handle sensor SW3. The second outside lever 10 is pivoted counterclockwise around the pivot 24 against the spring 35. Releasing action is transmitted to the subsidiary lever 11, the emergency lever 9 and the release lever 12. Releasing action of the release lever 12 is transmitted to the fully-closed door latch devices DL2, DL1 via the motion-transmitting member 64. The fully-closed door latch devices DL2, DL1 are released to enable the door D to open. The control carries out opening control of the electric door opening device PSD based on an opening signal of the outside handle detecting sensor SW3.

The Inside Handle IH is Operated to Open the Fully-Closed Door in FIG. 4.

The inside handle IH is operated to open the door D in FIG. 4. Opening action is transmitted to the inside lever 3 via the inside handle shaft 22. In FIG. 8, the inside lever 3 is pivoted clockwise around the inside handle shaft 22 against the spring 20 from its neutral position to release the engagement. Releasing action is transmitted to the inside handle sensor SW1 via the contact portion 3*c* and the inside handle detecting lever 17.

The opening inside lever 8 is pivoted counterclockwise around the shaft 24 against the spring 35 to release the engagement. Releasing action is transmitted to the engagement pin 18, the subsidiary lever 12 and the emergency lever 9. With the releasing action of the opening inside lever 8, the engagement pin 18 moves forward, but is a position where it cannot come in contact the contact portion 5*a* of the switch lever 5. The engagement pin 18 does not come in contact with the contact portion 5*a*, and the switch lever 5 does not operate.

The release lever 12 is pivoted with releasing action of the opening release lever 8, and the releasing action is transmitted to the fully-closed door latch device DL2 via the motion-transmitting member 64 and to the fully-closed door latch device DL1 via the motion-transmitting member 65. Thus, the fully-closed door latch devices DL2, DL1 are released to enable the door D to open. Meanwhile, the control controls opening of the electric door opening device PSD based on an opening signal of the inside handle sensor SW1.

The Outside Handle OH is Operated to Open the Fully-Closed Door D in FIG. 6.

In FIG. 6, the outside handle OH is operated to open the door D. Opening action is transmitted to the first outside lever 7 via the motion-transmitting member 63. The first outside lever 7 is pivoted counterclockwise around the shaft 23 to release the engagement. Releasing action is transmitted to the second outside lever 10 via the connecting rod 53, while the detected portion 7*c* comes in contact with the outside handle sensor SW3.

In this case, releasing action of the second outside lever 10 is not transmitted to the release lever 12 because the engagement pin 33 of the locking mechanism is in the lock position. Unless the portable key is communicated with the ECU, the fully-closed door latch devices DL2, DL1 are not released, so that the door D cannot be opened.

Even if an opening signal is transmitted to the control from the outside handle sensor SW3, the control does not carry out drive control for the releasing actuator AC2 and opening drive control of the electric door opening device PSD. If the portable key is communicated with the ECU, an opening signal is supplied into the control from the outside handle sensor SW3 though the locking mechanism is in the lock state. The locking actuator AC1 is controlled for unlocking, and the locking mechanism is turned to the unlock state. Thereafter, the releasing actuator AC2 is controlled, and the electric door opening device PSD is controlled to open the door D.

The Inside Handle IH is Operated to Open the Fully-Closed Door D in FIG. 6.

The inside handle IH is operated to open the door D in FIG. 6. The opening action is transmitted to the inside lever 3 via the inside-handle shaft 22. Thus, the inside lever 3 is pivoted clockwise from the neutral position around the inside-handle shaft 22 against the spring 20 to release the engagement. Releasing action is transmitted to the opening inside lever 8 via the bent portion 3*b* and to the inside handle sensor SW1 via the contact portion 3*c* and the inside-handle detecting lever 17.

The opening inside lever 8 is pivoted counterclockwise around the shaft 24 against the spring 35 to release the engagement. Releasing action is transmitted to the engagement pin 18, subsidiary lever 11 and emergency lever 9, but is not transmitted to the release lever 12 because the engagement pin 33 of the locking mechanism is in the lock position. In this state, forward motion of the engagement pin 18 with releasing action of the opening inside lever 8 is not transmitted to the switch lever 5.

Even when the inside handle IH is operated to open the door D, the fully-closed door latch devices DL2, DL1 are not released, so that the door D cannot be opened. Furthermore, a signal is transmitted from the inside handle sensor SW1 to the control, which does not carry out opening control of the electric door opening device PSD.

The Outside Handle OH is Operated to Open the Fully-Closed Door D in FIG. 7

In FIG. 7, the outside handle OH is operated to open the door D. Opening action is transmitted to the first outside lever 7 via the motion transmitting member 63. In a similar manner to the childproof mechanism in the unlock state, releasing action of the first outside lever 7 is transmitted to the fully-closed door latch devices DL2, DL1 via the connecting rod 53, second outside lever 10, subsidiary lever 11, engagement pin 33, release lever 12 and motion-transmitting member 64. Thus, the fully-closed door latch devices DL2, DL1 are released to enable the door D to open. The control carries out opening control of the electric door opening device PSD based on an opening signal of the outside-handle sensor SW3.

The Inside Handle IH is Operated to the Fully-Closed Door D in FIG. 7.

The inside handle IH is operated to open the door D in FIG. 7. Opening action is transmitted to the inside lever 3 via the inside handle shaft 22. In FIG. 9, the inside lever 3 is pivoted clockwise from the neutral position around the inside handle shaft 22 against the spring 20 to release the engagement. Releasing action is transmitted to the opening inside lever 8 via the bent portion 3*b*.

In the childproof lock state in FIG. 9, the engagement pin 18 is in the childproof-lock position where the engagement pin 18 is not capable of contacting the contact portion 11*a* of the subsidiary lever 11 but is capable of contacting the contact portion 5*b* of the switch lever 5, and the slider 19 is in the lock position where the upper end 17*a* of the inside-handle detecting lever 17 is not capable of contacting the contact portion 19*b*. Thus, forward motion of the engagement pin 18 with releasing action of the opening inside lever 8 is not transmitted to the subsidiary lever 11 but is transmitted to the switch lever 5.

In FIG. 9, the switch lever 5 pivots counterclockwise around the shaft 22 through a predetermined angle, and the detecting portion 5*b* of the switch lever 5 comes in contact with the childproof sensor SW2. Thus, the childproof sensor SW2 turns on from off. The control controls the electric door opening device PSD so that opening control thereof cannot be carried out.

The Inside Handle IH is Operated to Close the Fully-Open Door D in FIG. 4.

In FIG. 7, the inside handle IH is operated to close the door D. Closing action is transmitted to the inside lever 3 via the inside handle shaft 22. In FIG. 11, the inside lever 3 is pivoted counterclockwise from its neutral position around the inside handle shaft 22 against the spring 30 to release the engagement. Releasing action is not transmitted to the opening inside lever 8, but is transmitted to the closing inside lever 13.

The closing inside lever 13 pivots clockwise from its initial position against the spring 31 to release the engagement. Releasing action is transmitted to the fully-open door latch device DL3 via the motion-transmitting member 6. Thus, the fully-open door latch device DL3 is released from the striker to enable the door D to close.

The inside lever 3 pivots counterclockwise to close the door D, and the contact portion 3*c* of the inside lever 3 comes in contact with the upper end 17*a* of the inside-handle detecting lever 17 from front even when the slider 19 is in the childproof lock position to make the inside-handle detecting lever 17 pivot clockwise from its neutral position. Thus, the inside handle sensor SW1 turns on from off, and the control carries out closing control of the electric door opening device PSD based on an on signal from the inside handle sensor SW1.

The vehicle door operating device in this embodiment comprises the opening inside lever 8 that performs releasing action owing to opening action of the inside handle on the door inside the vehicle; the childproof lock lever 4 that moves between a childproof unlock position and a childproof lock position, the switch lever 5 that does not move with the releasing action of the opening inside lever 8 when the childproof lock lever 4 is in the childproof unlock position, but moves with the releasing action of the opening inside lever 8 when the childproof lock lever 4 is in the childproof lock position; the childproof sensor SW2 that can detect action of the switch lever 5; a single engagement pin 18 with which the releasing action of the opening inside lever 8 can be transmitted to the fully-closed door latch devices DL2, DL1 for holding the door closed, but cannot be transmitted to the switch lever 5 when the childproof lock lever 4 is in the childproof unlock position and the releasing action of the opening inside lever 8 cannot be transmitted to the fully-closed door latch devices DL2, DL1 but can be transmitted to the switch lever 5 when the childproof lock lever 4 is in the childproof lock position. With simple structure such as the single engagement pin, the opening action of the inside handle IH cannot be transmitted to the fully-closed door latch devices DL2, DL1, but can be transmitted to the switch lever 5 when the childproof lock lever 4 is in the childproof lock position.

What is claimed is:

1. A vehicle door operating device comprising:

a door that can be opened and closed by driving a motor, an inside lever, a childproof lock lever, a switch lever, and an inside handle, which are rotatably supported by a first shaft inside the door respectively;

an opening inside lever that is rotatably supported by second shaft inside the door and is released by the inside lever activated by opening the inside handle;

a fully-closed door latch device which places the door in a closed position; and wherein the childproof lock lever is configured to be movable between a childproof unlock position and a childproof lock position;

a childproof sensor that detects operation of the switch lever by contacting the switch lever and disables driving of the door, and a single engagement pin configured to be movable in an elongate hole provided in the childproof lock lever and in an elongate hole provided in the opening inside lever;

wherein, when the childproof lock lever is in the childproof unlock position, the switch lever is configured to enable driving of the door without being interlocked with the releasing action of the opening inside lever, the single engagement pin being configured to not contact the switch lever;

wherein, when the childproof lock lever is in the childproof lock position, the switch lever is configured to disable driving of the door by moving in a direction of contact with the childproof sensor, the single engagement pin being configured to contact the switch lever upon operation of the opening inside lever;

wherein, when the childproof lock lever is in the childproof unlock position, the release lever is configured to enable transmitting the releasing action of the opening inside lever to the fully-closed door latch device via the single engagement pin; and wherein, when the childproof lock lever is in the childproof lock position, the release lever is configured to disable transmitting the releasing action of the opening inside lever to the fully-closed door latch device by not contacting the engagement pin.

* * * * *